United States Patent [19]

Gill

[11] Patent Number: 4,608,772

[45] Date of Patent: Sep. 2, 1986

[54] MARKER

[76] Inventor: Carlton Gill, 114-07 127th St., South Ozone Park, N.Y. 11420

[21] Appl. No.: 524,963

[22] Filed: Aug. 19, 1983

[51] Int. Cl.[4] ..... G09F 11/04

[52] U.S. Cl. ..... 40/495; 40/107; 40/109; 40/110; 116/235; 116/236; 116/309; 116/323

[58] Field of Search ..... 40/495, 491, 110, 115, 40/107, 109, 111, 113, 120; 116/234, 236, 309, 235, 238, 323, 325, 200; 281/42; D18/10; 235/88 R, 83, 74, 90, 65, 69, 77

[56] References Cited

U.S. PATENT DOCUMENTS

| | | | |
|---|---|---|---|
| 399,768 | 3/1889 | Mehrer | 116/235 |
| 509,722 | 11/1893 | Dalton et al. | 235/83 |
| 670,766 | 3/1901 | Carleton | 116/309 |
| 828,353 | 8/1906 | Walsh | 116/309 |
| 1,497,955 | 6/1924 | Stevens | 116/234 |
| 1,598,322 | 8/1926 | Showalter | 116/323 |
| 1,661,110 | 2/1928 | Cox | 40/109 |
| 1,727,440 | 9/1929 | Meyer | 40/110 |
| 2,089,772 | 8/1937 | Thalau | 116/323 |
| 2,136,490 | 11/1938 | Cohen | 116/236 |
| 2,219,841 | 10/1940 | Harless | 116/323 |
| 2,268,886 | 1/1942 | McNamara | 235/83 |
| 2,305,370 | 12/1942 | Wissing | 40/110 |
| 3,266,456 | 8/1966 | O'Reilly | 116/235 |
| 3,884,113 | 5/1975 | Leonard | D18/10 |
| 3,918,390 | 11/1975 | Bosco | 116/309 |
| 4,251,935 | 2/1981 | Wright | 40/109 |

FOREIGN PATENT DOCUMENTS

| | | | |
|---|---|---|---|
| 38468 | of 1957 | Poland | 40/495 |

*Primary Examiner*—Robert Peshock
*Assistant Examiner*—J. R. Hakomaki
*Attorney, Agent, or Firm*—Jordan and Hamburg

[57] ABSTRACT

A marker for separately indicating a plurality of related materials comprising a base plate including a first section having at least one numeral row circularly arranged thereon and a second section having an area on which a plurality of predetermined items are printed. A plurality of pointers are rotationally situated in the center of a first section of the base plate, and an indicator is situated in a second section of the base plate. The indicator includes a guide groove extending through the area where the printed items are indicated, and a plurality of sliding pins slidably situated in the guide groove to immovably point the items when required. The pointers are independently moved relative to each other without influencing the other pointers and are marked to be distinguished from each other. The sliding pins of the indicator are marked to correspond to the pointers respectively for recording necessary information by mutual cooperation.

4 Claims, 5 Drawing Figures

MARKER

BACKGROND OF THE INVENTION AND DISCLOSURE ART STATEMENT

The present invention relates to a marker for recording names, chapters, pages and so on among selected books.

Especially, the marker of the invention is designed to record verses, chapters and names of the books in the Old and New Testament. In church, passages from the Old and New Testament are frequently cited. When a passage is cited, however, verse, chapter and name of the book only are recited instead of a page of a book. This is because since the Old and New Testament actually consists of 66 books, bibles in handy types are edited differently and contain only some famous and important chapters. Sometimes, a bible does not include a particular chapter cited in a church service. Therefore, if someone wants to read later an entire verse or chapter of the book cited in a church service, he has to write on a paper the verse, chapter and name of the particular book. Actually, many passages are cited in a single service, so that it is troublesome to write such information.

As stated above, the marker of the invention is especially designed to be used for recording verses, chapters and books of the Old and New Testament. However, the marker can be used for other purposes, such as by students for recording particular pages and names of books to be studied later. Namely, pages and names of books can be indicated by the marker of the invention.

As adjustable bookmarks, those of U.S. Pat. Nos. 1,249,980, 1,497,955 and 2,136,490 are known, wherein pages; lines and other data can be indicated. However, the bookmarks are designed to record several items relating to a single matter, such as one marker should be used for each book to indicate a page and a line.

U.S. Pat. Nos. 533,811 and 746,847 disclose indices relating to books of the Old and New Testament. However, these patents do not include systems to record verses, chapters and names of books.

None of the above prior patents discloses a marker for recording materials relating to different books. Especially, there is no marker separately indicating particular verses, chapters and books in the Old and New Testament.

Accordingly, one object of the invention is to provide a marker which can indicate or record a plurality of sets of related items.

Another object of the invention is to provide a marker as stated above, which is compact and simple and can be used easily.

A further object of the invention is to provide a marker as stated above, which can be economically manufactured.

Further objects and advantages of the invention will be apparent from the following description of the invention.

SUMMARY OF THE INVENTION

In accordance with the invention, a marker for separately indicating a plurality of related materials is shown. The marker comprises a base plate including a first section having at least one numeral row circularly arranged thereon, and a second section having an area on which a plurality of predetermined items are indicated, first pointing means including a plurality of pointers rotationally situated in the center of the first section of the base plate, and second pointing means situated in the second section of the base plate. The second pointing means includes a guide groove extending through the area where the predetermined items are indicated, and a plurality of sliding pins slidably situated in the guide groove to immovably point to the items when required. The pointers of the first pointing means are independently moved relative to each other without influencing other pointers and are marked to be distinguished from each other. The sliding pins are marked to correspond to the pointers of the first pointing means respectively, so that necessary information can be separately recorded by mutual cooperation of the first and second pointing means.

The first pointing means includes a plurality of sets of pointers, each set of pointers including at least two pointers of different size for indicating different materials. Each set of pointers of the first pointing means and one sliding pin of the second pointing means are marked to form one group.

Preferably, the first section of the base plate includes first and second numeral rows. The first numeral row is located outside the second numeral row so that the large size and the small size of the pointers are adapted to point to the first and second numeral rows respectively. The first and second numeral rows respectively indicate chapters and verses of the Old and New Testament, and the items on the second section indicate names of books of the Old and New Testament. Therefore, names, chapters and verses of the Testament to be memorized can be indicated by the pointers and the sliding pins.

DETAILED DESCRIPTION OF PREFERRED EMBODIMENTS

Figure 1:
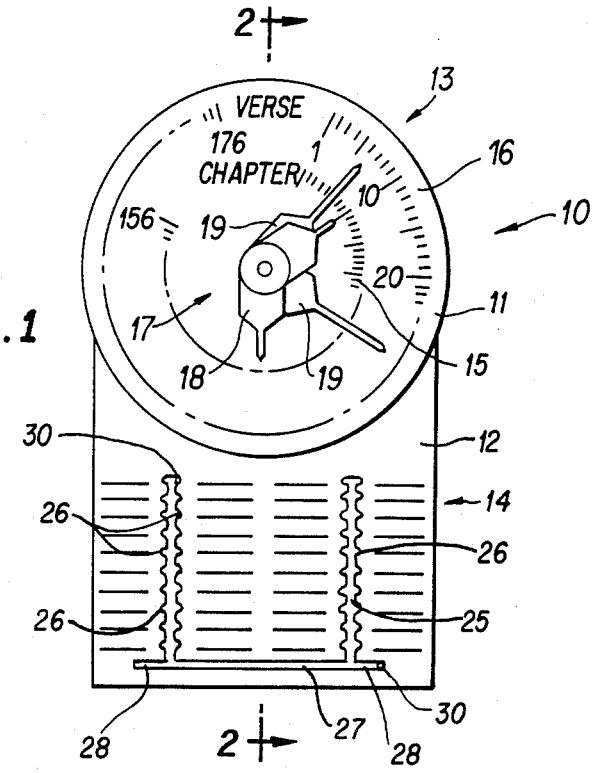
FIG. 1 is a plan view of a marker in accordance with the present invention, which is modified to indicate verses, chapters and names of books in the Old and New Testament.
Figure 4:
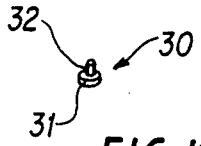
FIG. 4 is an enlarged perspective view of a sliding pin in second pointing means to be used in a marker.
Figure 2:
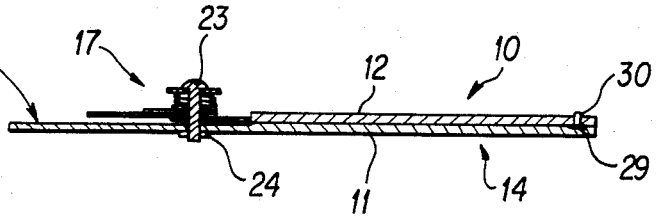
FIG. 2 is a section view taken along lines 2—2 in FIG. 1.

Referring to FIGS. 1–4, a marker 10 in accordance with the present invention is shown. In the particular embodiment, the marker 10 is designed to indicate verses, chapters and names of books in the Old and New Testament. When required, necessary information can be recorded in the marker 10.

The marker 10 basically comprises plates 11, 12 and is divided into a round section 13 and a bottom section 14. The round section 13 contains the words "Chapter" and "Verse", and inner and outer numeral rows 15, 16 imprinted thereon. The inner numeral row 15 shows "Chapter" containing numerals from 1 to 156, and the outer numeral row 16 shows "Verse" containing numerals from 1 to 176. Consequently, all the chapters and verses in the Old and New Testament can be covered and designated by the numerals in the numeral rows 15, 16.

Figure 3:
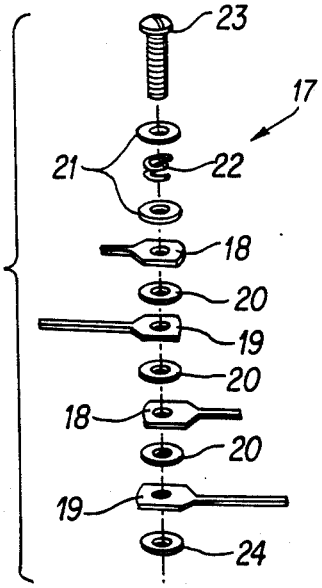
FIG. 3 is an exploded perspective view of first pointing means to be used in a marker.

Disposed in the center of the round section 13 is positioning means 17. As shown in FIG. 3, the positioning means 17 comprises two short pointers 18 and two long pointers 19, and three separating sheets 20 situated between the pointers. The positioning means 17 further includes two washers 21, a spring 22 between the washers 21, a bolt 23 and a nut 24. The bolt 23 passes through the washers 21, the spring 22, the short and long pointers 18, 19 and the separating sheets 20, and is connected to the base plate 11 in the center of the round section 13 by means of the nut 24.

Since the pointers 18, 19 are pushed downwardly by the spring 22, the pointers 18, 19 do not freely rotate. Further, since the separating sheets 20 are disposed between the pointers, even if one of the pointers are rotated, the other pointers are not affected and stay in the particular positions as they were.

The bottom section 14 of the marker 10 is divided into four columns, wherein names of the books of the Old and New Testament are imprinted on the plate 12. The plate 12 includes between the respective two columns two vertical slits 25 with notches 26 extending outwardly from the slit 25, and a horizontal slit 27 communicating with the slits 25. The slit 27 includes extensions 28 at both ends extending outwardly beyond the slits 25. The slits 25, 27 are provided with a space 29 between the plates 11, 12, and the width of the space 29 is greater than that of the slits 25, 27.

Slide pins 30 are slidably situated in the slits 25, 27. Namely, the slide pin 30 includes a bottom portion 31 and a post 32, wherein the bottom portion 31 is located in the space 29 and the post 32 is located in the slit 25 or 27. The slide pins 30 are generally located in the extensions 28 of the slit 27, and when required, the slide pin 30 is moved to a particular notch 26 through the slit 25. When the slide pin 30 is strongly pushed into the notch 26, the post 32 is engaged with the notch 26, so that the slide pin 30 is held in the notch 26.

In the particular embodiment as shown in FIG. 1, two short and long pointers 18, 19 and two slide pins 30 are employed, but they are divided into two groups. Each group includes one short pointer 18, one long pointer 19 and one slide pin 30 and is marked in the same color to be distinguished from another group. If necessary, four or five groups may be employed in the marker 10. In use, when the user receives information regarding chapter, verse and name of a book, the user moves the short pointer 18, the long pointer 19 and the slide pin 30, respectively, to indicate the required data. For example, when the information is a particular name of a book, chapter 10, verse 6, the short and long pointers 18, 19 are respectively moved to point numerals "10" and "6", and the slide pin 30 is moved to the notch 26 adjacent to the name of the particular book. These data can be read later.

Figure 5:
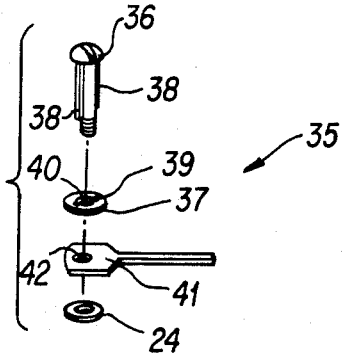
FIG. 5 is an exploded perspective view for showing a part of another example of first pointing means.

FIG. 5 shows a part of positioning means 35 similar to the positioning means 17. The positioning means 35 is different from the positioning means 17 in respect to a bolt 36, separating sheets 37, and short and long pointers. The bolt 36 includes two side projections 38 extending in the longitudinal direction of the bolt 36, while the separating sheet 37 includes two side notches 39 with a central hole 40. When the separating sheet 37 is inserted into the bolt 36, the notches 39 engage the side projection 38, so that the sheet 37 never rotates relative to the bolt 36. The pointers (the long pointer 41 is shown in FIG. 5) are provided with a large hole 42, so that when the pointers are situated around the bolt 36, the pointers can freely rotate relative to the bolt 36. In the positioning means 35, the washers 21, the spring 22, the short and long pointers, the separating sheets 37 and the nut 24 are arranged similar to the positioning means 17 as shown in FIG. 3. In the embodiment of FIG. 5, the separating sheets 37 never rotate, so that the short and long pointers can freely rotate without influencing other pointers.

In the embodiments, verses, chapters and names of the books in the Old and New Testament are indicated or recorded, but in case the numeral rows 15, 16 are designed to respectively indicate two digits, it is possible to thereby indicate pages under ten thousand. Also, it is possible to write any kind of names in the bottom section 14, such as names of books studied in school.

The invention has been described with reference to the specific embodiments of the invention, but the embodiments are illustrative and the invention is limited only by the appended claims.

What is claimed is:

1. A marker for separately indicating a plurality of related information comprising:

a base plate including a first section having at least one numeral row circularly arranged thereon, and a second section adjacent to the first section and having an area on which a plurality of printed items are indicated;

pointing means including a central axis situated in the center of the first section of the base plate, a plurality of pointers rotationally held by means of the central axis to indicate numerals on the first section, and a spring situated around the central axis for pressing the pointers to prevent the pointers from free rotation relative to the base plate, said pointers being independently moved relative to each other without influencing other pointers and being marked to be distinguished from each other, and indicating means situated in the second section of the base plate, said indicating means including two first guide grooves parallel to each other and extending through the area where the printed items are indicated, each first guide groove having a plurality of notches adjacent to the items indicated on the second section, a second groove extending perpendicularly to the first guide grooves and connected to said second groove having extensions at both ends thereof extending beyond the first guide grooves, and a plurality of sliding pins slidably situated in said first guide grooves and second groove, said sliding pins being disposed in ends of said first guide grooves, said extensions when not used and being located in the notches to indicate the items when used, said sliding pins being marked to correspond to the respective pointers of the pointing means for recording necessary information by mutual cooperation of the pointing means and indicating means.

2. A marker according to claim 1, in which said first section of the base plate includes a first circular band indicia and a second circular band indicia situated inside the first circular band, and said pointing means includes a plurality of sets of pointers, each set of pointers having two pointers of different size so that the larger size and the smaller size pointers are adapted to point to the first and second circular bands, respectively, each set of pointers and one sliding pin of the indicating means being marked to form one group.

3. A marker according to claim 2, in which said pointing means further comprises a plurality of separating members situated between the adjacent pointers, said separating members being immovably attached to the central axis so that the pointers can be independently rotated and held in a suitable position relative to the base plate.

4. A marker according to claim 1, in which said first and second circular bands indicate chapters and verses of the Old and New Testament respectively, and said items on the second section indicate names of books of the Old and New Testament, so that names, chapters and verses of the Testament to be recorded can be indicated by the pointers and the sliding pins.

* * * * *